US008516684B2

(12) United States Patent
Maple

(10) Patent No.: US 8,516,684 B2
(45) Date of Patent: Aug. 27, 2013

(54) PLANAR MAGNETIC STRUCTURE

(71) Applicant: Delphi Technologies, Inc., Troy, MI (US)

(72) Inventor: Robert D. Maple, Fishers, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 13/782,517

(22) Filed: Mar. 1, 2013

(65) Prior Publication Data

US 2013/0174414 A1 Jul. 11, 2013

Related U.S. Application Data

(62) Division of application No. 13/049,082, filed on Mar. 16, 2011.

(51) Int. Cl.
*H01F 7/06* (2006.01)

(52) U.S. Cl.
USPC ..... 29/602.1

(58) Field of Classification Search
USPC ..... 336/65, 192, 196, 198, 220–223; 29/602.1, 604–609
See application file for complete search history.

(56) References Cited

U.S. PATENT DOCUMENTS

| | | | |
|---|---|---|---|
| 5,179,365 | A | 1/1993 | Raggi |
| 5,886,610 | A | 3/1999 | Canova |

FOREIGN PATENT DOCUMENTS

| | | | |
|---|---|---|---|
| EP | 0 435 461 | A2 | 7/1991 |
| EP | 0 820 072 | A1 | 1/1998 |
| EP | 1 536 436 | A1 | 6/2005 |
| JP | 2008 103371 | A | 5/2008 |

*Primary Examiner* — Tuyen Nguyen
(74) *Attorney, Agent, or Firm* — J. Gordon Lewis

(57) ABSTRACT

A planar magnetic structure has an electrically insulating carrier made up of a base portion and opposed upstanding sidewalls. A plurality of planar primary windings and planar secondary windings are interstitially disposed within the carrier with planar dielectric spacers located between each adjacent pair of windings. A ferrite core envelopes the assembly to magnetically couple the windings. The carrier and windings form at least two spaces-apart sets of cooperating registration features which maintain the windings in fixed alignment with the carrier.

21 Claims, 7 Drawing Sheets

DP-317355
Delphi Technologies, Inc., Troy, MI

PLANAR MAGNETIC STRUCTURE

RELATED APPLICATIONS

The present application is a divisional application of U.S. Ser. No. 13/049,082 filed 16 Mar. 2011.

TECHNICAL FIELD OF THE INVENTION

The present invention relates to a method for the manufacture of planar magnetic structures and planar magnetic structures manufactured in accordance therewith.

BACKGROUND OF THE INVENTION

Planar magnetic structures, such as transformers, offer many advantages over traditional magnetic devices. These advantages include less weight, lower profiles, smaller footprints, design flexibility and greater efficiency.

International safety standards set many of the parameters for the design of these devices. The spacing distance between primary and higher-order windings required to withstand a given working voltage is specified in terms of creepage and clearance. "Creepage" is defined as the shortest distance between two electrically active parts as measured along an insulative path. "Clearance" which is defined as the shortest distance between two electrically active parts as measured in air, must be, for instance, at least 4 mm for operating voltages of less than 250V. Additionally, the thickness of the sheets of dielectric used as spacers between the windings must be at least 0.4 mm.

A popular method of assembling planar magnetic devices uses thin, stamped metal windings interleaved with thin spacers of dielectric material for isolation. These metal windings are single-turn due to the extreme flexibility of the thin metal when they are fashioned with many turns. This flexibility adversely affects both the alignment of the winding and the manufacturability of the assembly. In instances where there is a need for a large number of turns in a winding, either several of the single-turn windings are connected together, thickening the stack-up, or a substrate with a metal film patterned in a multiple-winding configuration is used.

Another disadvantage in the current art is the use of a thick centrally placed dielectric bobbin, which acts as a holder for the interleaved layers while providing enhanced isolation between the primary and secondary windings by completely encompassing the primary winding, thereby addressing the creepage and clearance specifications for these devices.

The use of the bobbin is disadvantageous in two ways. First, leakage inductance for these assemblies is relatively high because its value depends largely on the thickness of the insulating material between the primary and secondary windings of a magnetic device, and the bobbin is much thicker than the thin dielectric spacers used for interleaving with the windings outside of the bobbin. Second, despite the high surface-to-volume ratio of these devices which normally would allow for a large heat removal capacity, removing heat from that portion of the assembly which is surrounded by the thick bobbin is difficult. These problems are compounded when a thick substrate is employed for the primary winding in devices which require a many-turned winding.

Yet another method of assembling these devices bypasses the bobbin and uses an over molding process to fully encapsulate the assembly. The layers are placed into a carrier positioned at the bottom of the stack, with spacers provided to maintain relatively large air gaps between the planar metal windings and dielectric spacers to allow the mold compound to fully penetrate between the interleaved layers. The resulting assembly does not have creepage and clearance issues, but the over molding compound greatly increases the leakage inductance and makes heat removal problematic. Cracking of the mold compound during thermal cycling is also a concern with this type of assembly.

Therefore, an object of the present invention is to provide a planar magnetic device that can meet clearance and creepage requirements without the use of either a substrate or thick central bobbin while minimizing the parasitic inductance between the primary and secondary windings and facilitating the removal of heat from the assembly.

Another object of this invention is to provide a planar magnetic device which can provide for the use of planar metal windings with more than one turn without employing the use of a substrate.

Still another object of this invention is to provide a method of assembling such a planar magnetic device.

SUMMARY OF THE INVENTION

In accordance with the present invention, there is provided a planar magnetic device comprising a ferroelectric core, and interleaved dielectric spacers and planar metal windings aligned using a unique carrier. The carrier contains several alignment aids which act to keep each piece of the assembly in optimal alignment. These alignment aids also allow for the use of planar metal windings which have more than one turn. By implementing these improvements, the use of both central bobbins and substrates is not required, thereby lowering leakage inductance and enhancing the cooling capability of the assembly.

In another aspect, the invention provides a method of making such a planar magnetic device. The method includes the steps of providing a carrier with alignment facilitators fashioned for the particular application, interleaving thin dielectric spacers and planar winding members into the carrier using the alignment facilitators, and attaching a ferrite core to the stacked components. Varied layer arrangements may be used depending on the desired application.

Further features and advantages of the invention will appear more clearly on a reading of the following detailed description of the preferred embodiment of the invention, which is given by way of non-limiting example only and with reference to the accompanying drawings.

These and other features and advantages of this invention will become apparent upon reading the following specification, which, along with the drawings, describes preferred and alternative embodiments of the invention in detail.

BRIEF DESCRIPTION OF THE DRAWINGS

The present invention will now be described, by way of example, with reference to the accompanying drawings, in which.

Figure 1:
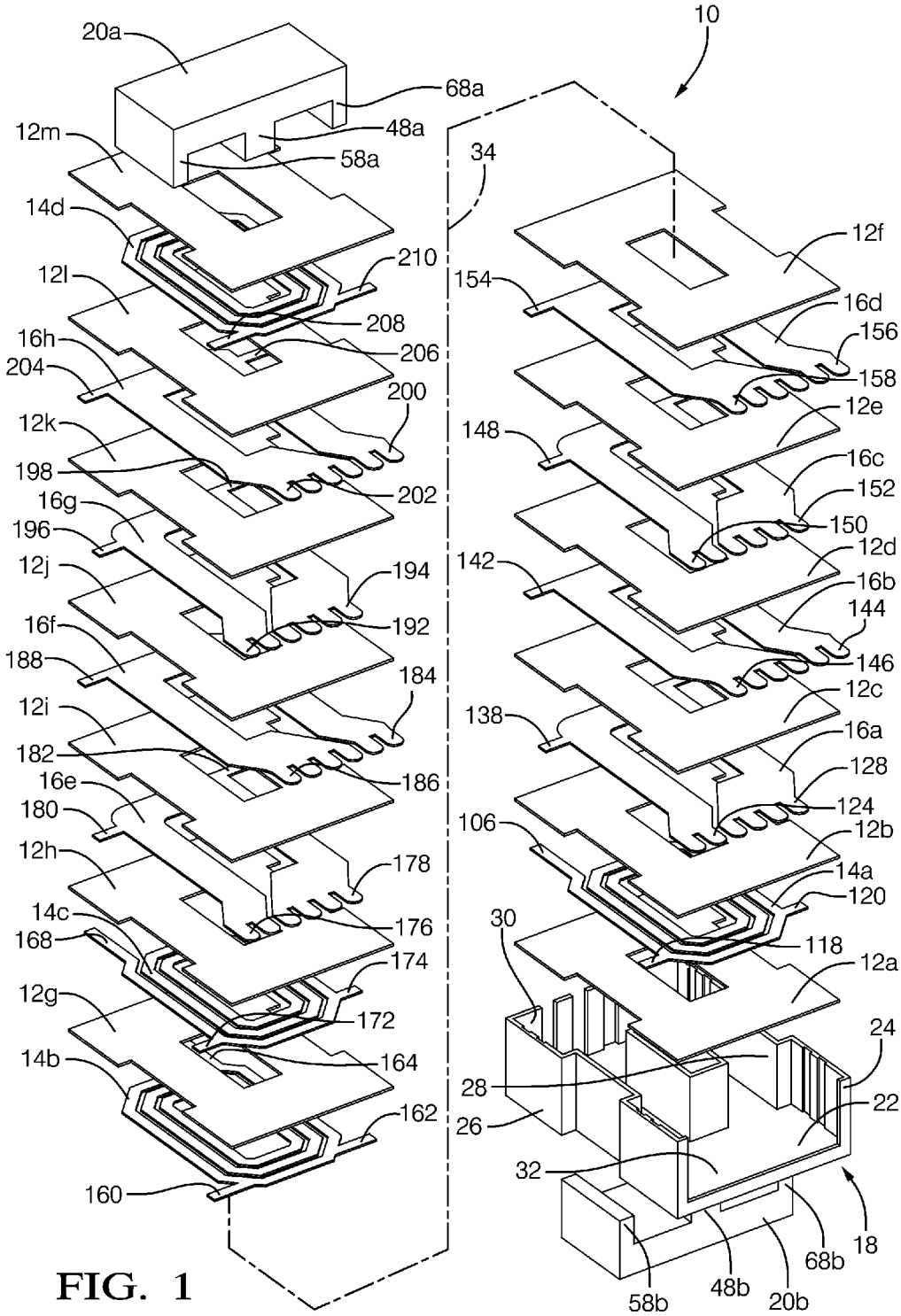
FIG. 1, is an exploded perspective view of a planar magnetic device in accordance with the preferred embodiment of this invention.

Although the drawings represent embodiments of the present invention, the drawings are not necessarily to scale and certain features may be exaggerated in order to illustrate and explain the present invention. The exemplification set forth herein illustrates an embodiment of the invention, in one form, and such exemplifications are not to be construed as limiting the scope of the invention in any manner.

DETAILED DESCRIPTION A PREFERRED EMBODIMENT OF THE INVENTION

Magnetic parts generally utilize some form of coil forming structure. On large utility type of transformers they are usually called coil formers. For smaller parts they are called bobbins. In many bobbins, pins are inserted to provide an electrical termination for the magnet wire. For larger planar magnetic transformers and inductors they may be configured more like buckets. Sometimes the high voltage windings are enclosed in an envelope structure for isolation purposes. In the present invention, the term "carrier" is intended to describe all such similarly functioning structures.

One of the challenges in transformer and inductor design is to maximize the core window copper fill and, at the same time, providing the proper insulating spacing for voltage isolation. One of the more effective approaches used with large planar parts is to surround (envelop) the high voltage windings with a plastic isolator structure. This approach increases the parasitic leakage inductance by the thickness of the plastic wall. The parasitic inductance becomes an unwanted energy storage device. The stored energy has to be discharged every cycle and becomes a major source of voltage overshoot in the attached switching devices. Another effective technique is to utilize the bucket approach which provides a convenient potting structure. The problem with this approach is that potting compounds that can be used in applications where there is a large temperature gradient are expensive and tend to crack during temperature cycling.

One of the reasons for moving to higher switching frequencies is so that the magnetic parts become smaller. One limitation on the size reduction is the generated eddy currents within the copper conductors. Another limitation is the parasitic elements as indicated. A third limitation is the isolation requirements. Creepage and clearance distance requirements requited by published standards can be several millimeters.

The present invention provides a mechanical method that eliminates the need for surrounding the high voltage windings (stampings for high current), holds the conductor alignment to a close tolerance which minimizes the insulation requirement, and provides the minimum parasitic leakage inductance, and in totality, allows for maximum usage of the core window space.

The present invention resides primarily in apparatus components and method steps related to planar magnetic devices. For illustrative purposes only, a step-down planar transformer consisting of four (4) multi-turn primary windings and eight (8) separate single turn secondary windings is used in the description of the invention. Accordingly, the apparatus components and method steps represented in drawing FIGS. 1 through 7 depict this device, showing only those specific details that are pertinent to understand the invention. It will be appreciated by those skilled in the art that other devices can be assembled using the techniques detailed below.

One contemplated embodiment of the present invention applies to planar magnetic structures requiring copper stamps for the conductors and uses inserted pins and/or locating features built into the carrier to maintain the precision alignment of the copper conductors required to maintain the minimum insulation width that will satisfy the creepage and clearance requirements. The example used to illustrate this structure is a 2200W, 350V: 13.5V, 100 kHz transformer operating in a category 2 environment. In this example, the required clearance to core which is grounded is 2 mm. This requirement is satisfied by the base and walls of the carrier. The creepage distance between the primary and the secondary is 5.15 mm. This requirement can be met by extending the insulation beyond the copper stampings by 2.275 mm if the stamps can be held in exact alignment. In practice, this is extremely difficult to accomplish. However, the insulation width can be held to a minimum by features built into the carrier that holds the alignment as close as possible. The key is to space the alignment features as far apart as possible and to provide two dimensional alignments.

As an example, the "E" core describer herein is 58 mm. Wide by 25 mm. Deep. The window is 21 mm. by 25 mm. The minimum distance between the inside walls and the insulation allowing for a 1 mm. carrier wall and tolerance is 2 mm This leaves a maximum copper width of 12 mm. if the assembly is maintained in close alignment. The illustrated embodiment of the invention employs a combination of pins and notches and slots formed in the carrier walls to provide the alignment. Twelve copper stamps are employed to comprise the transformer. At least three sets of cooperating locating features are involved in maintaining the precision alignment between each copper stamp and the carrier. Finally, the illustrated carrier configuration is extremely robust.

Referring to FIG. 1, an exploded view of a step-down planar magnetic device 10 is illustrated to depict internal details thereof. Thirteen interleaved dielectric spacers (numbered 12*a*-12*m*), four primary planar windings (numbered 14*a*-14*d*) and eight secondary windings (numbered 16*a*-16*h*), are shown as serially stacked into an electrically insulating carrier 18 to form a step-down planar transformer. A ferrite core 20 consisting of an upper "E" shaped half 20*a* and a lower "E" shaped half 20*b* encircles the device 10 to magnetically couple the windings 14 and 16. Assembly of the device 10 is affected by applying the discrete components upwardly or downwardly along an assembly axis 34.

Figure 2:
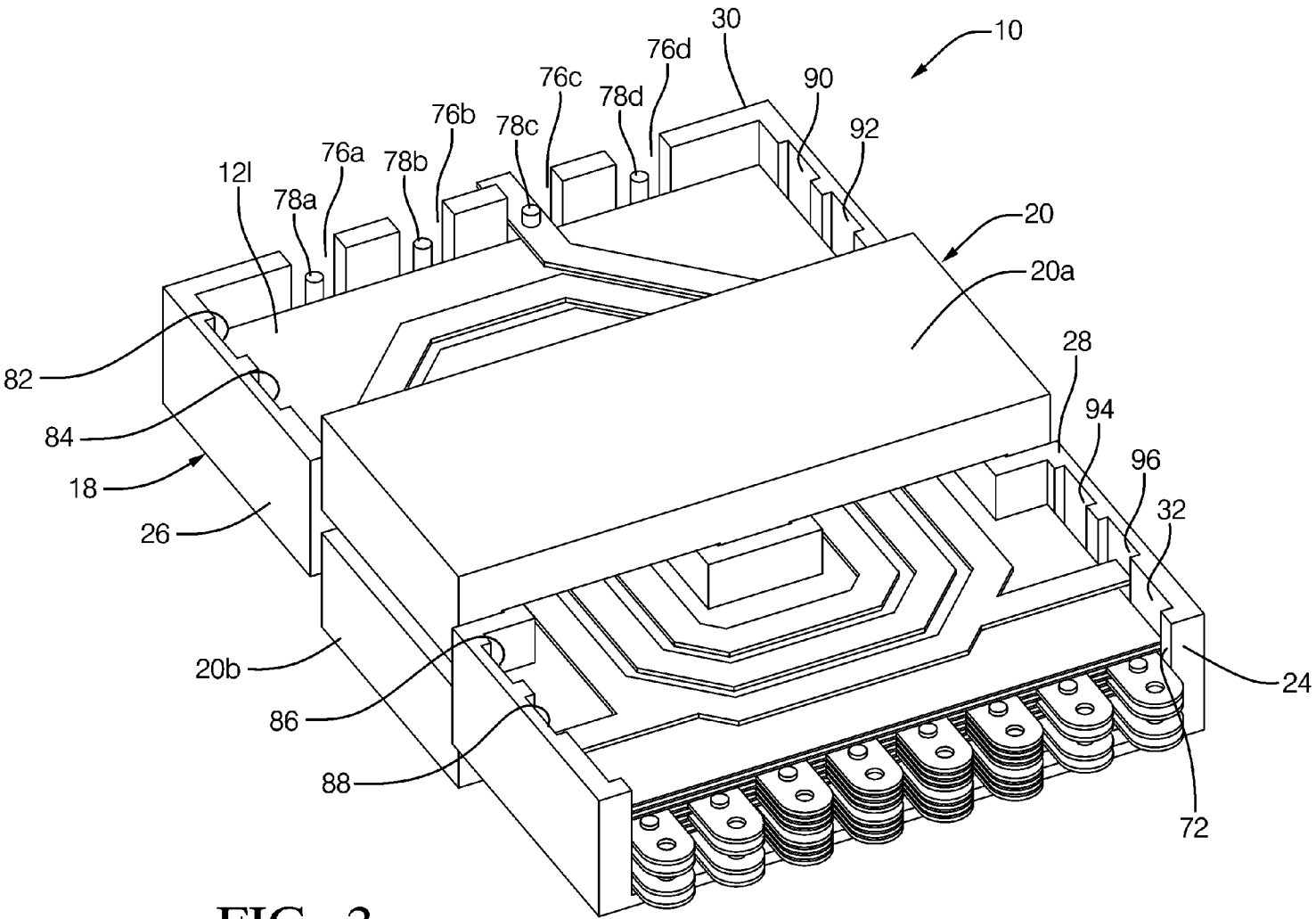
FIG. 2, is a perspective view of the device of FIG. 1 as fully assembled on an enlarged scale.

FIG. 2 illustrates a perspective view of the device 10 as fully assembled. Top dielectric spacer 12*m* is illustrated as removed in FIG. 2 to reveal the uppermost primary winding 14*d* underneath. Carrier 18 is integrally formed of electrically insulating material such as plastic in a generally box-like configuration defining a base or bottom portion 22 and a plurality of vertically upstanding sidewalls including a front wall portion 24, a left side wall portion 26, a right side wall portion 28 and a rear wall portion 30 extending upwardly normally from the base portion 22. The uppermost portion of the carrier 18 (opposed from the base portion 22) is substantially open for nestingly receiving the interleaved dielectric spacers 12*a*-12*m*, the primary windings 14*a*-14*d* and the secondary windings 16*a*-16*h* within a regularly-shaped cavity 32 formed thereby.

Definitionally, the term "regularly-shaped" means that the nominal cross-section of the cavity 32 taken along planes parallel to and spaced above the base portion 22 of carrier 18 remain substantially constant in shape and dimension throughout the vertical extent of the cavity 32. This ensures a precise interfit of the interleaved dielectric spacers 12*a*-12*m*, the primary windings 14*a*-14*d* and the secondary windings 16*a*-16*h* when stacked within the cavity 32. Furthermore, this ensures that the interleaved dielectric spacers 12*a*-12*m*, the primary windings 14*a*-14*d* and the secondary windings 16*a*-16*h* must be installed from above (refer FIG. 1) along assembly axis 34, and once positioned within cavity 32 of carrier 18, each of the elements (dielectric spacers 12*a*-12*m*, the primary windings 14*a*-14*d* and the secondary windings 16*a*-16*h*) are lockingly engaged bi-directionally, both longitudinally and laterally within cavity 32 (refer FIG. 2).

Figure 3:
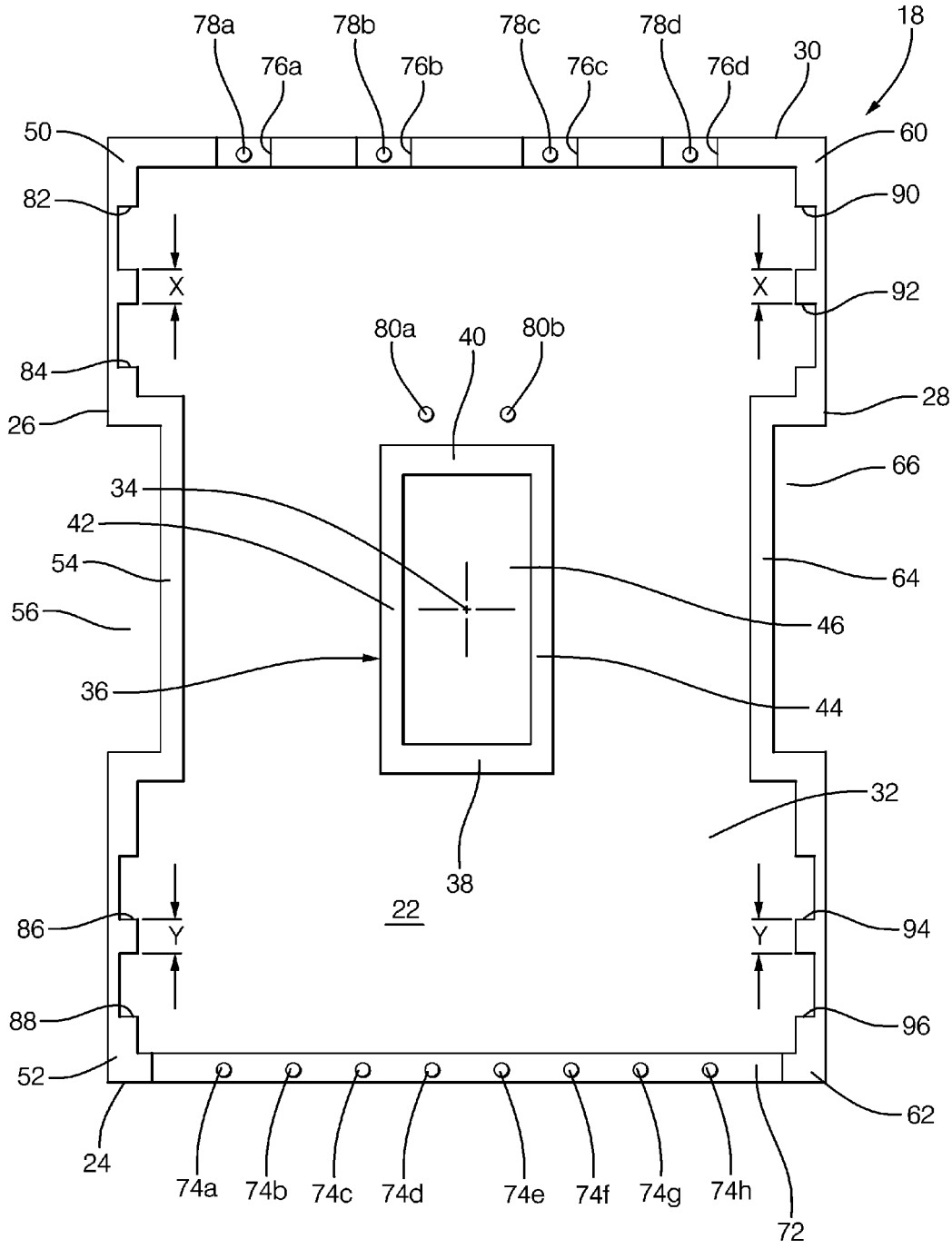
FIG. 3, is a top plan view of the carrier of FIG. 1 in accordance with the preferred embodiment of the invention.

As best viewed in FIG. 3, an overhead plan view of the carrier 18 illustrates the nominal shape of the cavity 32. The carrier 18 forms a box-like inner structure 36 composed of parallel front and rear walls 38 and 40, respectively, and parallel left and right side walls 42 and 44, respectively, integrally formed with and extending upwardly from base portion 22. The inner structure 36 is located concentrically with assembly axis 34, and forms a rectangular through passage 46 for receiving the center legs 48*a* and 48*b* of the opposed ferrite core portions 20*a* and 20*b*, respectively. In essence, inner structure 36 functions as a bobbin for positioning the ferrite core portions 20*a* and 20*b*, as well as the dielectric spacers 12*a*-12*m*.

Left side wall portion 26 of carrier 18 has a first end segment 50 adjacent rear wall 30, a second end segment 52 adjacent front wall 24, and an intermediate recessed center segment 54 there between. The inward transitions between the end segments 50 and 52 with the center segment 54 forms an outwardly opening pocket 56 configured to nestingly receive first end legs 58*a* and 58*b* of core portions 20*a* and 20*b*, respectively, therein. Likewise, right side wall portion 28 mirrors left side portion 26 and has a first end segment 60 adjacent rear wall 30, a second end segment 62 adjacent front wall 24, and an intermediate recessed center segment 64 there between. The inward transitions between the end segments 60 and 62 with the center segment 64 forms an outwardly opening pocket 66 configured to nestingly receive second end legs 68*a* and 68*b* of core portions 20*a* and 20*b*, respectively, therein.

Front wall portion 24 of carrier 18 preferably forms a single, laterally elongated opening 72 therein. Eight, laterally spaced-apart posts 74*a*-74*h* extend vertically from the base portion 22, terminating in a plane substantially corresponding with the uppermost surface portions of the carrier walls. The posts 74*a*-74*f* are equally spaced apart and are formed of electrically insulating material.

The rear wall portion 30 of carrier 18 preferably forms four, laterally spaced-apart openings 76*a*-76*d* therein. A single post 78*a*-78*d* is centered in each opening 76*a*-76*d*, extending vertically from the base portion 22, terminating in a plane substantially corresponding with the uppermost surface portions of the carrier walls. The posts 78*a*-78*d* are formed of electrically insulating material.

Referring to FIG. 2, openings 76*a*-76*d* allow primary winding termination connection terminals to exit through the rear sidewall 30 of carrier 18 for electrical interconnection with an associated electrical circuit. Similarly, secondary winding connection terminals are shown exiting through the opening 72 in the front sidewall 24 of carrier 18 for electrical interconnection with an associated electrical circuit.

Two additional raised posts 80*a* and 80*b* are positioned between the rear wall 40 of the inner structure 36 and the rear side wall portion 30 of the carrier 18, proximal to raised center aperture structure 36 and are the same height as the sidewalls 24, 26, 28 and 30 of carrier 18. Raised posts 80*a* and 80*b* are spaced approximately 3 mm apart and differ from raised posts 74*a*-74*h* and 78*a*-78*d* in that they are constructed of electrically conductive material or are integrally formed as part of carrier 18 and are covered by a layer of conductive material such as copper. Posts 80*a* and 80*b* are electrically isolated from one another. These posts 80*a* and 80*b* serve as contact points for primary windings 14*a*-14*d*.

Referring to FIGS. 2 and 3, the first wall segment 50 of the left side wall portion 26 of the carrier 18 forms first and second generally rectangular recesses 82 and 84, respectively, opening into cavity 32. The recesses 82 and 84 are preferable equally sized and extend vertically from the base portion 22 to the top of wall portion 26 of the carrier 18. The recesses 82 and 84 are longitudinally spaced by a dimension designated "X". The second wall segment 52 of the left side wall portion 26 of the carrier 18 forms third and fourth generally rectangular recesses 86 and 88, respectively, opening into cavity 32. The recesses 86 and 88 are preferable equally sized and extend vertically from the base portion 22 to the top of wall portion 26 of the carrier 18. The recesses 86 and 88 are longitudinally spaced by a dimension designated "Y".

Similarly, the first wall segment 60 of the right side wall portion 28 of the carrier 18 forms first and second generally rectangular recesses 90 and 92, respectively, opening into cavity 32. The recesses 90 and 92 are preferably equally sized and extend vertically from the base portion 22 to the top of wall portion 28 of the carrier 18, mirroring opposed wall portion 26. The recesses 90 and 92 are longitudinally spaced by a dimension designated "X". The second wall segment 62 of the right side wall portion 28 of the carrier 18 forms third and fourth generally rectangular recesses 94 and 96, respectively, opening into cavity 32. The recesses 94 and 96 are preferable equally sized and extend vertically from the base portion 22 to the top of wall portion 28 of the carrier 18, mirroring opposed wall portion 26. The recesses 94 and 96 are longitudinally spaced by a dimension designated "Y".

Definitionally, posts 74*a*-74*h*, 78*a*-78*d*, 80*a*, 80*b*, and recesses 82, 84, 86, 88, 90, 92, 94 and 96 are designated as "alignment features", :registration features" or "alignment facilitators" associated with or part of the carrier 18.

Figure 4:
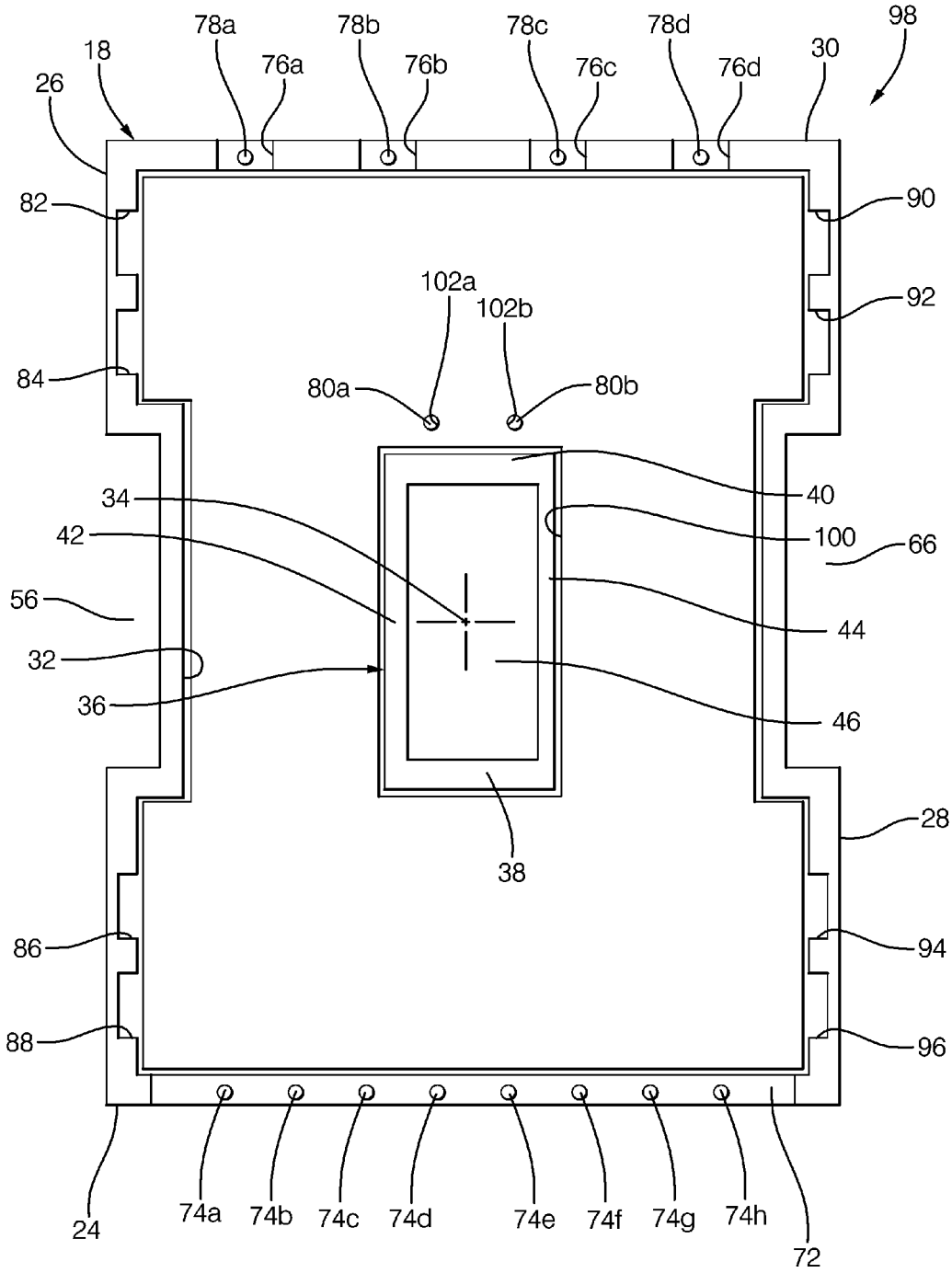
FIG. 4, is a top plan view of a partially assembled magnetic device showing a dielectric spacer nestingly disposed within in the carrier in accordance with the preferred embodiment of the invention.

Referring to FIG. 4, a subassembly 98 composed of dielectric spacer 12*a* nestingly installed with cavity 32 of carrier 18 is illustrated. Dielectric spacer 12*a* is dimensioned and configured in the general form of a Roman Numeral "II", whereby its outer peripheral edge surfaces are, upon installation, closely spaced from opposed adjacent inner wall surfaces of wall portions 24, 26, 28 and 30 of the carrier 18. Furthermore, dielectric spacer 12*a* has a centrally-located rectangular opening 100 concentrically aligned with the inner structure 36 of the carrier 18, whereby inner peripheral edge surfaces formed by the opening 100 are, upon installation, closely spaced from opposed adjacent outer surfaces of walls 38, 40, 42 and 44 of the inner structure 36 of the carrier 18. Two laterally spaced openings 102*a* and 102*b* are formed in dielectric spacer 12*a* concentrically aligned with and dimensioned to receive posts 80*a* and 80*b*, respectively, there through. Upon installation of the first dielectric spacer 12*a* within the cavity 32 of the carrier 18, the lower wall surface of dielectric spacer 12*a* lays upon the upper surface of the base portion 22 of the carrier 18 with the inner structure 36 extending upwardly through the rectangular opening 100, and .posts 80*a* and 80*b* extending upwardly through openings 102*a* and 102*b*, respectively. Insodoing, dielectric spacer 12*a* is positively interlocked with carrier 18, preventing relative lateral and longitudinal displacement.

Figure 5:
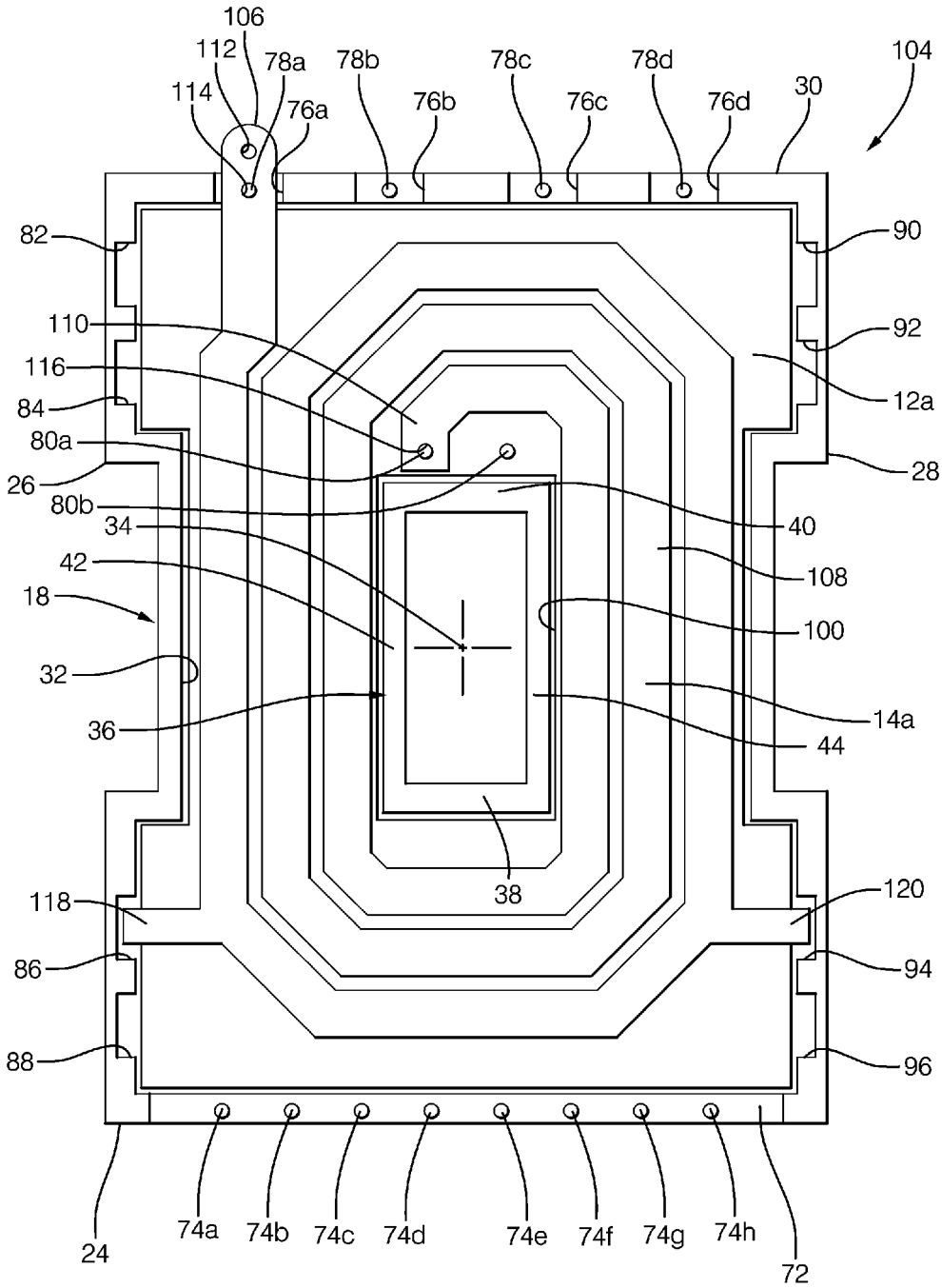
FIG. 5, is a top plan view of a partially assembled magnetic device according to the preferred embodiment of the invention showing a three-turn primary winding assembled into the carrier.

Referring to FIG. 5, a subassembly 104 composed of three-turn primary winding 14*a* installed atop dielectric spacer 12*a* nestingly installed within cavity 32 of carrier 18 is illustrated. Primary winding 14*a* is formed of conductive sheet material, such as copper, forming a continuous spiral loop consisting of a first termination portion or terminal 106, an intermediate portion 108 and a second termination portion or terminal 110. First terminal 106 extends outwardly of cavity 32 through opening 76*a* to provide external electrical connectability thereto. First terminal 106 has a first opening 112 adjacent its free end suitable for attachment to an external electrical conductor (not illustrated) and a second opening 114 cooperatively receiving post 78*a* there through to mechanically secure the first terminal 106 with rear wall portion 30 of the carrier 18. The second terminal 110 has a single opening 116 cooperatively receiving post 80*a* there through in a close tolerance press fit to both mechanically secure the second terminal 110 to the carrier 18 via the post 80*a* and to electrically interconnect the second terminal 110 with the post 80*a* for electrical interconnection with other winding terminals within the device 10.

The intermediate portion 108 of primary winding 14*a* lays upon the upper surface of dielectric spacer 12*a* and spirals radially inwardly around the inner structure 36, from the first terminal 106 to the second terminal 110. The intermediate portion 108 of primary winding 14*a* is generally elliptically shaped, defining three windings. It is contemplated that more or fewer windings can be employed. Both terminal portions 106 and 110 are located adjacent one (upper, as illustrated) end of the ellipsoid winding arrangement.

First and second alignment tabs 118 and 120, respectively, are integrally formed with the radially outermost winding of intermediate portion 108 of primary winding 14*a* at an end of the ellipsoid winding arrangement opposed from terminal portions 106 and 110. The alignment tabs 118 and 120 are preferably a mirror-image of one another, extending radially leftwardly and rightwardly, respectively, from the outermost winding of primary winding 14*a*, and nestingly terminating within inwardly opening recesses 86 and 94 formed in left and right side wall portions 26 and 28 of the carrier 19, respectively, Tabs 118 and 120 are formed co-planer with the remainder of primary winding 14*a* and, thus, lay upon the exposed upped surface of the underlying dielectric spacer 12*a*. Thus arranged, alignment tabs 118 and 120 cooperatively provide lateral and longitudinal support to the intermediate portion 108 of the primary winding 14*a*.

Figure 6:
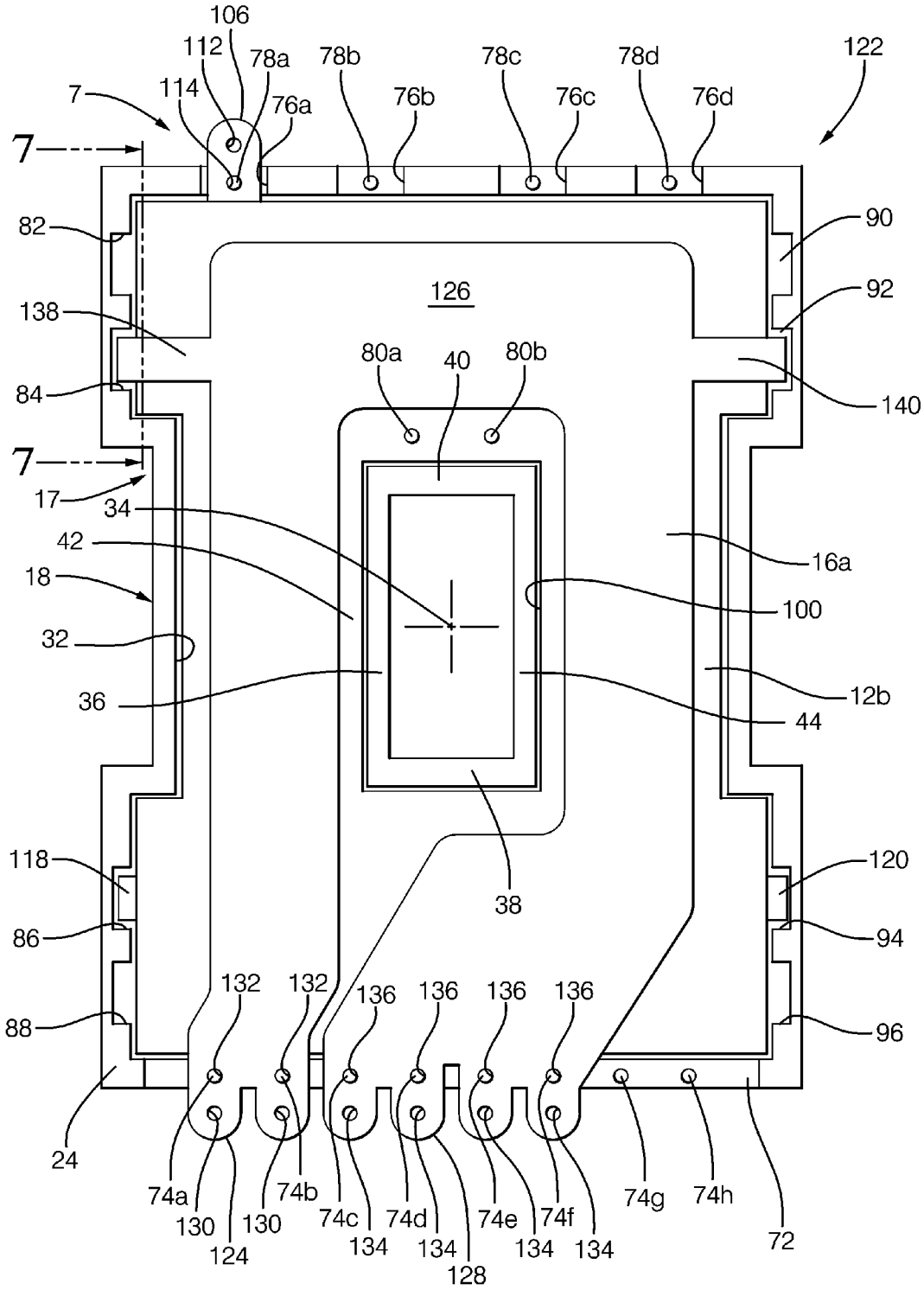
FIG. 6, is a top plan view of a partially assembled magnetic device according to the preferred embodiment of the invention showing a one-turn secondary winding assembled into the carrier.

Referring to FIG. 6, a subassembly 122 composed of one-turn secondary winding 16*a* installed atop dielectric spacer 12*b* nestingly installed within cavity 32 of carrier 18 is illustrated. Dielectric spacer 12*b* overlays primary winding 14*a* and dielectric spacer 12*a* as depicted in FIG. 5. Secondary winding 16*a* is formed of conductive sheet material, such as copper, forming a continuous loop consisting of a first termination portion or terminal 124, an intermediate portion 126 and a second termination portion or terminal 128. First terminal 124 extends outwardly of cavity 32 through opening 72 to provide external electrical connectability thereto. First terminal 124 is dual-lobed wherein each lobe has a first opening 130 adjacent its free end suitable for attachment to an external electrical conductor (not illustrated) and a second opening 132 cooperatively receiving posts 74*a* and 74*b* there through to mechanically secure the first terminal 124 with front wall portion 24 of the carrier 18. The second terminal 128 extends outwardly of cavity 32 through opening 72 to provide external electrical connectability thereto. The first terminal 124 is laterally spaced from second terminal 128 to provide electrical isolation there from. Second terminal 128 is four-lobed wherein each lobe has a first opening 134 adjacent its free end suitable for attachment to an external electrical conductor (not illustrated) and a second opening 136 cooperatively respectively receiving posts 74*c*, 74*d*, 74*e* and 74*f* there through to mechanically secure the second terminal 128 to the carrier 18 via the posts 74*c*-74*f*.

The intermediate portion 126 of secondary winding 16*a* lays upon the upper surface of dielectric spacer 12*b* and circumscribes the inner structure 36, from the first terminal 124 to the second terminal 128. The intermediate portion 126 of secondary winding 16*a* is generally elliptically shaped, defining one winding. It is contemplated that more windings can be employed. Both terminal portions 124 and 128 are located adjacent one (lower, as illustrated) end of the ellipsoid winding arrangement.

First and second alignment tabs 138 and 140, respectively, are integrally formed with the radially outermost winding of intermediate portion 126 of secondary winding 16*a* at an end of the ellipsoid winding arrangement opposed from terminal portions 124 and 128. The alignment tabs 138 and 140 are preferably a mirror-image of one another, extending radially leftwardly and rightwardly, respectively, from the outermost winding of secondary winding 16*a*, and nestingly terminating within inwardly opening recesses 84 and 92 formed in left and right side wall portions 26 and 28 of the carrier 19, respectively, Tabs 138 and 140 are formed co-planer with the remainder of secondary winding 16*a* and, thus, lay upon the exposed upped surface of the underlying dielectric spacer 12*b*. Thus arranged, alignment tabs 138 and 140 cooperatively provide lateral and longitudinal support to the intermediate portion 126 of the secondary winding 16*a*.

Referring to FIG. 1, the continued alternate stacking or interleaved arrangement of the magnetic device 10 is illustrated. After installation of the secondary winding 16*a* depicted in FIG. 6, dielectric spacer 12*c* is installed within the cavity 32. Next, secondary winding 16*b* is installed. Secondary winding 16*b* is a mirror image of secondary winding 16*a* with the sole exception that the left and right alignment tabs 142 extend laterally from the rearward most part of the intermediate portion of the secondary winding 16*b* for nesting interfit within carrier side wall portion recesses 82 and 90, respectively. Secondary winding 16*b* has a first, two-lobed first termination portion 144 affixed to posts 74*g* and 74*h*, and a second, four lobed termination portion 146 affixed to posts 74*c*-74*f*.

Next, dielectric spacer 12*d* and secondary winding 16*c* are installed. Secondary winding 16*c* is identical to secondary winding 16*a*, including left and right alignment tabs 148 extending laterally from the intermediate portion of the secondary winding 16*c* for nesting interfit within carrier side wall portion recesses 84 and 92, respectively. Secondary winding 16*c* has a first, two-lobed first termination portion 150 affixed to posts 74*a* and 74*b*, and a second, four lobed termination portion 152 affixed to posts 74*c*-74*f*.

Next, dielectric spacer 12*e* and secondary winding 16*d* are installed. Secondary winding 16*d* is identical to secondary winding 16*b*, including left and right alignment tabs 154 extending laterally from the rearward most part of the intermediate portion of the secondary winding 16*d* for nesting interfit within carrier side wall portion recesses 82 and 90, respectively. Secondary winding 16*d* has a first, two-lobed first termination portion 156 affixed to posts 74*g* and 74*h*, and a second, four lobed termination portion 158 affixed to posts 74*c*-74*f*.

Next, dielectric spacer 12*f* and primary winding 14*b* are installed. Primary winding 14*b* is a minor image of primary winding 14*a* with the exceptions that left and right alignment tabs 160 and 162, respectively, extend laterally from the rearward most part of the intermediate portion of the primary winding 14*b* for nesting interfit within carrier side wall portion recesses 88 and 96, The first termination portion 164 of primary winding 14*b* extends outwardly of carrier 18 through opening 76*d* affixed to post 78*d*. The second termination portion 166 (not illustrated) is affixed to post 80*b* within cavity 32 of carrier 18.

Next, dielectric spacer 12*h* and secondary winding 16*e* are installed. Secondary winding 16*e* is identical to secondary winding 16*a* with the first two-lobe termination portion 176 of secondary winding 16*e* extending outwardly of carrier 18 through opening 72 affixed to posts 74*a* and 74*b*. The second four-lobe termination portion 178 also extends outwardly through opening 72 and is affixed to posts 74*c*-74*f*. Left and right alignment tabs 180 and 182, respectively, extend laterally from the intermediate portion of the secondary winding 16*e* for nesting interfit within carrier side wall portion recesses 84 and 92, respectively.

Next, dielectric spacer 12*i* and secondary winding 16*f* are installed. Secondary winding 16*f* is identical to secondary winding 16*b* with the first two-lobe termination portion 184 of secondary winding 16*f* extending outwardly of carrier 18 through opening 72 affixed to posts 74*g* and 74*bh*. The second four-lobe termination portion 186 also extends outwardly through opening 72 and is affixed to posts 74*c*-74*f*. Left and right alignment tabs 1808 and 190, respectively, extend laterally from the intermediate portion of the secondary winding 16*f* for nesting interfit within carrier side wall portion recesses 82 and 90, respectively.

Next, dielectric spacer 12*j* and secondary winding 16*g* are installed. Secondary winding 16*g* is identical to secondary winding 16*a* with the first two-lobe termination portion 192 of secondary winding 16*g* extending outwardly of carrier 18 through opening 72 affixed to posts 74*a* and 74*b*. The second four-lobe portion 194 also extends outwardly through opening 72 and is affixed to posts 74*c*-74*f*. Left and right alignment tabs 196 and 198, respectively, extend laterally from the intermediate portion of the secondary winding 16*g* for nesting interfit within carrier side wall portion recesses 84 and 92, respectively.

Next, dielectric spacer 12*k* and secondary winding 16*h* are installed. Secondary winding 16*h* is identical to secondary winding 16*b* with the first two-lobe termination portion 200 of secondary winding 16*h* extending outwardly of carrier 18 through opening 72 affixed to posts 74*g* and 74*bh*. The second four-lobe termination portion 202 also extends outwardly through opening 72 and is affixed to posts 74*c*-74*f*. Left and right alignment tabs 204 and 206, respectively, extend laterally from the intermediate portion of the secondary winding 16*h* for nesting interfit within carrier side wall portion recesses 82 and 90, respectively.

Next, dielectric spacer 12*l* and primary winding 14*d* are installed. Primary winding 14*d* is a minor image of primary winding 14*c* with the exceptions that left and right alignment tabs 2080 and 210, respectively, extend laterally from the rearward most part of the intermediate portion of the primary winding 14*d* for nesting interfit within carrier side wall portion recesses 88 and 96. The first termination portion 212 (not illustrated) of primary winding 14*d* extends outwardly of carrier 18 through opening 76*c* affixed to post 78*c*. The second termination portion 214 is affixed to post 80*b* within cavity 32 of carrier 18.

Finally, dielectric spacer 12*m* is positioned atop primary winding 14*d* and ferrite core half portions 20*a* and 20*b* are installed is illustrated in FIG. 2.

Definitionally, the second opening 114 in first termination portion 106, the opening 116 in second termination portion 110 and alignment tabs 118 and 120 formed in primary winding 14*a* are designated as "alignment features", :registration features" or "alignment facilitators". The second openings 132 in first termination portion 124, the second opening 136 in second termination portion 128 and alignment tabs 1318 and 140 formed in secondary winding 16*a* are designated as "alignment features", :registration features" or "alignment facilitators". Corresponding features formed in the other primary windings 14*b*-14*d*, and secondary windings 16*b*-16*h* are also designated as "alignment features", registration features" or "alignment facilitators".

Figure 7:
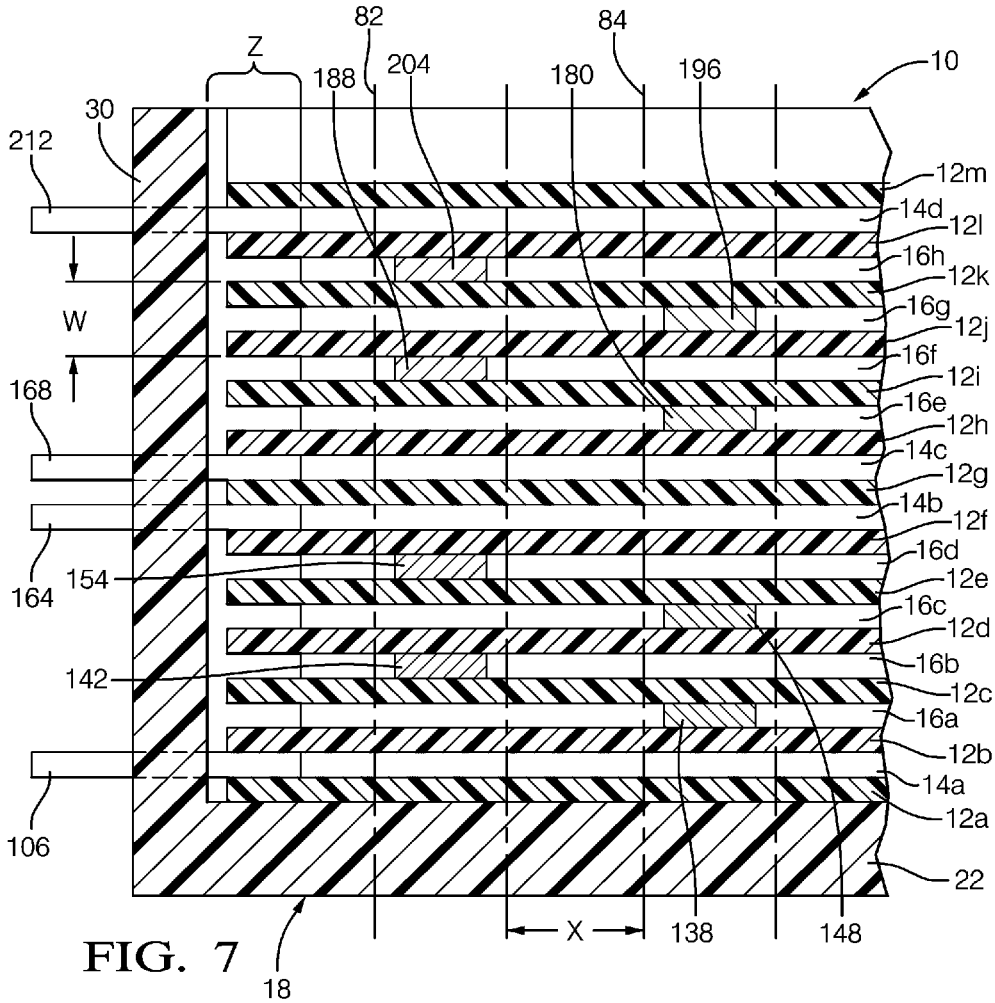
FIG. 7, is a broken, cross-sectional view of a fully-assembled device of FIG. 2 illustrating a complete assembly of a plurality of planar windings concentrically interleaved with adjacent pairs of a plurality of dielectric spacers disposed within an insulating carrier.

Referring to FIG. 7, a cross-sectional plan view taken on an enlarged scale through the first (rearmost) end segment 50 of the left side wall portion 26 of the carrier 18 illustrates the respective vertical positioning of the first termination portions 106, 164, 168 and 212 as they emerge rearwardly from rear wall portion 30 of carrier 18. Also illustrated is the relative vertical and longitudinal positioning of the left-side alignment tabs 138, 142, 148, 154, 180, 188, 196 and 204 as disposed in either first recess 82 or second recess 84 opening within carrier cavity 32. The alignment tabs 142, 154, 188 and 204 located within recess 82 are longitudinally spaced from the alignment tabs 1389, 148, 180 and 196 located within recess 84 by a minimum dimension designated "X" ("Y" in the case of the front corners). Furthermore, the alignment tabs located within a single recess are, at a minimum, vertically spaced from one another by a dimension equating to the sum of the nominal thickness of two adjacent dielectric spacers and an intermediate winding designated "W" which is recessed longitudinally and laterally inwardly from the outermost extent of the adjacent dielectric spacers by a dimension "Z". Similar arrangements are provided through the second (forward most) end segment 52 of the left side wall portion 26, the first (rearmost) end segment 60 of the right side wall portion 28, and the second (forward most) end segment 62 of the left side wall portion 26.

Figure 8:
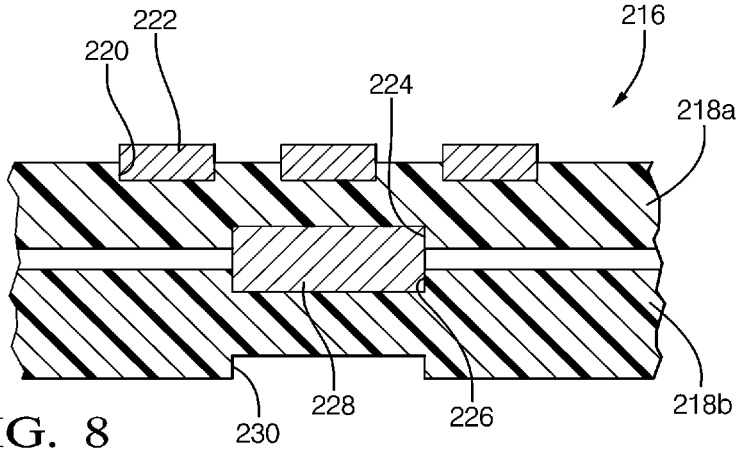
FIG. 8 is a broken, cross-sectional view of an alternate embodiment of the invention wherein consecutively stacked dielectric spacers have guides, such as recesses formed therein to lockingly engage an adjacent primary or secondary winding.

Referring to FIG. 8, a broken, cross-sectional view of a detail of an alternative feature of a step-down planar magnetic device 216 is illustrated. Device 216 is configured substantially as described herein above in connection with FIGS. 1-7, with the exception that a first dielectric spacer 218*a* has a recess 220 formed in the upper surface thereof dimensioned and configured to be substantially identical to that of an overlying primary winding 222. Primary winding 222 is partially located within recess 220 to provide both longitudinal and lateral support there between along the entire length of primary winding. Similarly, the bottom surface of dielectric spacer 218*a* has a recess 224 formed therein to receive the upper portion of a secondary winding 228. The upper surface of another dielectric spacer 218*b* forms a similar recess 226 which receiver the lower portion of secondary winding 228. Similarly, the lower surface of dielectric spacer 218*b* forms a downwardly opening recess 230 for receiving the upper portion of another secondary winding (not illustrated). Such a system or recesses or, alternatively, locating tabs can provide additional registration features.

Alignment tabs integrally formed with windings are keyed into alignment facilitators. Uppermost primary winding terminal tabs are illustrated, but the other windings not shown in FIG. 2 due to the stack-up of the assembly are also keyed into their proper alignment facilitators. The alignment facilitators in this embodiment are shown as vertically extending, generally rectangular grooves formed in the inner sidewalls of the carrier, but it should be understood that other means for aligning the layers could be used, such as, but not limited to, alignment posts with corresponding holes in the windings and dielectric spacers.

Two alignment facilitators for the primary windings are employed to create the exemplary device, but it should be appreciated that the number of alignment facilitators may be fewer or greater, depending on the desired device construct. For the illustrated example, the pairing of the windings with their associated alignment facilitators should be such that the alignment tabs for the first and third primary coils are keyed into a first, opposed pair of alignment facilitators in sides of the carrier closest to missing side. The second and fourth primary windings are similarly keyed into a second, opposed pair of alignment facilitators in the same sides closest to missing side and spaced from the first set of alignment facilitators. In a similar manner, the alignment tabs for the secondary windings, not shown, will be paired up with third and fourth opposed sets of alignment facilitators in sides of carrier closest to side. Other devices assembled using this method will take into account the proper placement of windings and alignment facilitators to suit the intended purpose.

Wrapped around the entire assembly are ferrite component parts, which together form a ferrite structure.

Referring now to FIG. 3, the carrier of the preferred embodiment is shown. Carrier has 4 raised sides and raised center aperture. Center aperture is surrounded by sidewalls that are the same height as the carrier sidewalls, typically 13 mm. This height will vary depending on the type of device and number of layers to be interleaved in the assembly. The sidewall is broken by openings. Four such openings are required to create the example structure, but this number will vary with the desired number of primary windings for other structures. Sidewall is absent. Disposed in the inner sidewalls of sides are alignment facilitators. These inset areas are typically 3 mm wide and remove approximately one-half the thickness of sidewalls. Raised posts are positioned central to the openings in sidewall and equally spaced within absent sidewall. Raised posts are the same height as carrier. Eight such raised posts are required to create the example structure, but this number will vary with the desired number of secondary windings in other structures.

Two additional raised posts are positioned between raised center aperture and sidewall, proximal to raised center aperture and are the same height as the sidewalls of carrier. Raised posts are spaced approximately 3 mm apart and differ from raised posts in that they are covered by a conductive layer such as copper or other metal by plating or any other method known in the art. These posts serve as contact points for primary windings.

Sidewalls are inset by about 6 mm along their length that corresponds to the walls of raised aperture. These inset areas 8, along with raised aperture, are keyed to accept ferrite component parts, thereby creating ferrite.

FIG. 4 shows carrier with the first of the interleaved layers, dielectric spacer in place. Dielectric spacer has a central opening that is large enough to surround center aperture and raised posts. There is typically 1 mm clearance between all sidewalls within and around carrier and dielectric spacer and typically 3 mm clearance between raised posts and dielectric spacer.

Referring to FIG. 5, the assembly is depicted with multi-turn primary winding in place in the carrier. Primary winding is disposed atop one of dielectric spacers. Terminal of primary winding which is nearest center aperture has hole therein which is matched with one of conductive raised posts closest to sidewall and placed there-around. In this manner, conductive posts can serve as connection points for other primary windings as the interleaving of dielectric spacers and windings progresses.

The other end of primary winding has therein two holes and. Innermost hole is matched with raised post centered within an opening in sidewall and placed there-around. Outermost hole is positioned central to end connection terminal of primary winding. Hole is to be used to create external connection to primary windings using conductive posts mounted to a substrate or any other manner known in the art. Two alignment tabs extend from the outer coil of primary winding to key into alignment facilitators in sidewalls of carrier.

FIG. 6 depicts a partially completed assembly with one of secondary windings at the top of the stack-up. Secondary winding is sitting atop one of dielectric spacers. End terminations of secondary winding have disposed therein two holes. Innermost hole on each end termination is matched to one of the raised posts spaced along absent side of carrier and placed there-around. The outermost hole is positioned central to end connection terminal of secondary winding. Holes are to be used to create external connection to the secondary windings by connection to conductive posts mounted to a substrate or any other manner known in the art. Two alignment tabs extend from the end of secondary winding closest to sidewall of carrier. These alignment tabs are designed to key into alignment facilitators in sidewalls of carrier. The pairing, if any, of secondary winding alignment tabs in alignment facilitators will be dependent on the type of device being assembled and its design.

Once assembled, the planar magnetic device 10 can be mounted on a substrate designed to accept the terminations of the planar windings in a manner that completes the devices intended function. Additionally, the use of thin dielectric spacers 12 during assembly will enhance the cooling of the device using any of the device cooling mechanisms known in the art.

While this invention has been described in terms of the preferred embodiments thereof, it is not intended to be so limited, but rather only to the extent set forth in the claims that follow.

It is to be understood that the invention has been described with reference to specific embodiments and variations to provide the features and advantages previously described and that the embodiments are susceptible of modification as will be apparent to those skilled in the art.

Furthermore, it is contemplated that many alternative, common inexpensive materials can be employed to construct the basis constituent components. Accordingly, the forgoing is not to be construed in a limiting sense.

The invention has been described in an illustrative manner, and it is to be understood that the terminology, which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for illustrative purposes and convenience and are not in any way limiting, the invention, which is defined by the following claims as interpreted according to the principles of patent law, including the Doctrine of Equivalents, may be practiced otherwise than is specifically described.

I claim:

1. A method of assembling a planer magnetic structure comprising the steps of:

forming an electrically insulating carrier comprising a base portion and a plurality of upstanding sidewalls forming a regularly shaped cavity;

forming a plurality of substantially planar dielectric spacers configured for nesting disposition within said cavity;

forming a plurality of substantially planar windings configured for disposition within said cavity, with each said planar winding interstitially disposed between an adjacent pair of said dielectric spacers; and forming a ferrite core operative to magnetically couple said windings, wherein said plurality of windings comprises a plurality of primary windings, with each primary winding forming a first outwardly extending alignment tab positioned to cooperatively register within a first vertical recess formed in a carrier sidewall, wherein said plurality of windings comprises a plurality of secondary windings, with each secondary winding forming a second outwardly extending alignment tab positioned to cooperatively register within a second vertical recess formed in a carrier sidewall, and wherein said first and second vertical recesses are longitudinally spaced-apart sufficiently to prevent electrical interconnection of said first and second alignment tabs and to maintain all of said windings in fixed alignment with said carrier.

2. The method of claim 1, wherein each said winding comprises a first termination portion, an intermediate portion including at least one turn, and a second termination portion.

3. The method of claim 2, wherein at least one of said winding termination portions extends outwardly through an associated opening in one of said carrier sidewalls, and both of said termination portions are affixed to carrier posts integrally formed with said base portion and extending upwardly therefrom.

4. The method of claim 3, wherein at least one of said carrier posts comprises an electrically conductive portion extending axially between two registering winding termination portions to establish an electrically conductive path there between.

5. The method of claim 2, wherein said first set of cooperating registration features comprises an opposed pair of laterally outwardly extending engagement tabs depending from said winding intermediate portion and terminating within an associated upwardly directed recess formed in an inner wall surface of said carrier.

6. The method of claim 5, wherein said second set of cooperating registration features comprises a second opposed pair of laterally outwardly extending engagement tabs depending from said winding intermediate portion of an adjacent winding and terminating within a second associated upwardly directed recess formed in an inner wall surface of said carrier, wherein said first recess is longitudinally spaced from said second recess.

7. The method of claim 5, wherein each of said engagement tabs are integrally formed with an associated winding.

8. The method of claim 7, wherein each of said engagement tabs are integrally formed on a radially outward most turn of an associated winding.

9. The method of claim 1, wherein said planar windings are formed of stamped metal.

10. The method of claim 1, wherein said ferrite core is disposed externally of said carrier.

11. The method of claim 1, wherein said first and second spaced-apart sets of cooperating registration features are spaced-apart by a minimal dimension exceeding the nominal thickness of one of said dielectric spacers.

12. The method of claim 1, wherein said base portion further comprises a plurality of upstanding inner walls forming an axial through passage and extending through registering openings in each of said dielectric spacers and windings.

13. The method of claim 12, wherein said ferrite core comprises cooperating end leg portions disposed within opposed outwardly opening recesses formed in outer surfaces of said sidewalls, and a center leg portion extending axially within said through passage.

14. The method of claim 1, wherein all of said planar windings are stacked within said cavity such that outer connection terminals of said planar windings comprising a primary winding extend through a first sidewall of said carrier and that outer connection terminals of said planar windings comprising a secondary winding extend through a sidewall opposite said first sidewall.

15. The method of claim 1, wherein any two of said planar windings have a combined total of at least 4 mm clearance from the edge of said dielectric spacers interleaved therebetween.

16. The method of claim 1, wherein the stamped metal planar windings have more than one turn.

17. A method of assembling a planer magnetic structure comprising the steps of:

forming an electrically insulating carrier comprising a base portion and a plurality of upstanding sidewalls forming a regularly shaped cavity;

forming a plurality of substantially planar dielectric spacers configured for nesting disposition within said cavity;

forming a plurality of substantially planar primary windings configured for disposition within said cavity, with each said planar primary winding interstitially disposed between an adjacent pair of said dielectric spacers, and each primary winding forming a second outwardly extending alignment tab positioned to cooperatively register within a first vertical recess formed in a carrier sidewall;

forming a plurality of substantially planar secondary windings configured for disposition within said cavity, with each said planar secondary winding interstitially disposed between an adjacent pair of said dielectric spacers, and each secondary winding forming a second outwardly extending alignment tab positioned to cooperatively register within a second vertical recess formed in a carrier sidewall; and forming a ferrite core operative to magnetically couple said windings, said carrier and said primary windings forming first and second spaced-apart sets of cooperating registration features operative to maintain said windings in fixed alignment with said carrier, and said carrier and said secondary windings forming third and fourth spaced-apart sets of cooperating registration features operative to maintain said windings in fixed alignment with said carrier.

18. The method of claim 17, wherein said first and second spaced-apart sets of cooperating registration features are spaced-apart by a first minimal dimension exceeding the nominal thickness of one of said dielectric spacers, and said third and fourth spaced-apart sets of cooperating registration features are spaced-apart by a second minimal dimension exceeding the nominal thickness of one of said dielectric spacers.

19. A method of assembling a planar magnetic structure comprising the steps of:

interleaving stamped planar metal windings and dielectric spacers into a non-conductive carrier having alignment facilitators that correspond to alignment mechanisms on said planar metal windings and dielectric spacers;

aligning said alignment mechanisms on said planar metal windings into said alignment facilitators on at least two sides;

securing the terminations of said planar metal windings using said alignment mechanisms and said alignment facilitators; and surrounding said carrier and interleaved dielectric spacers and planar metal windings with a ferrite core.

20. The method of claim 19 wherein all said planar windings are stacked such that said outer connection terminals of said planar windings comprising a primary winding extend through a first sidewall of said carrier and all said planar windings comprising secondary planar windings are stacked such that said connection terminals extend through the side opposite said first sidewall.

21. The method of claim 19 wherein any two of said planar windings have a combined total of at least 4 mm clearance from the edges of said dielectric spacers interleaved therebetween.

* * * * *